US009182190B2

(12) United States Patent
Khoshnood

(10) Patent No.: US 9,182,190 B2
(45) Date of Patent: Nov. 10, 2015

(54) LINEAR CLUTCH FOR USE WITH A BOW AND AN ARROW REST

(71) Applicant: Bahram Khoshnood, Alpharetta, GA (US)

(72) Inventor: Bahram Khoshnood, Alpharetta, GA (US)

( * ) Notice: Subject to any disclaimer, the term of this patent is extended or adjusted under 35 U.S.C. 154(b) by 101 days.

(21) Appl. No.: 13/735,589

(22) Filed: Jan. 7, 2013

(65) Prior Publication Data

US 2014/0190462 A1 Jul. 10, 2014

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
USPC ..... 473/44.5, 1, 86, 31, 34, 35.1, 37; 124/44.5, 1, 86, 31, 34, 35.1, 37
See application file for complete search history.

(56) References Cited

U.S. PATENT DOCUMENTS

| | | | | |
|---|---|---|---|---|
| 4,803,971 | A * | 2/1989 | Fletcher | 124/44.5 |
| 6,102,020 | A * | 8/2000 | Mizek et al. | 124/44.5 |
| 6,739,321 | B1 * | 5/2004 | Puchlerz | 124/44.5 |
| 8,434,464 | B1 * | 5/2013 | Terzo | 124/44.5 |
| 2001/0007164 | A1 * | 7/2001 | Arisaka et al. | 16/84 |
| 2008/0168971 | A1 * | 7/2008 | Mizek et al. | 124/44.5 |
| 2011/0168147 | A1 * | 7/2011 | Schaffer | 124/44.5 |

* cited by examiner

*Primary Examiner* — John E Simms, Jr.
(74) *Attorney, Agent, or Firm* — Brient Globerman, LLC

(57) ABSTRACT

A clutch for use with an arrow rest is mounted intermediate the arrow rest and the bow. The clutch includes a body having a first end configured to operatively connect to the arrow rest cord and a second end that receives a moveable shaft. The moveable shaft has a first end received in the body and a second end configured to connect to a bow. A spring is received on the shaft and positioned between the shaft and the clutch body. The clutch is moveable between a first position in which the shaft first end is proximate the clutch body first end to facilitate the movement of an arrow rest launcher arm out of an arrow support position, and a second position in which the shaft first end is proximate the clutch body second end to facilitate movement of the arrow rest launcher arm into an arrow support position.

25 Claims, 12 Drawing Sheets

LINEAR CLUTCH FOR USE WITH A BOW AND AN ARROW REST

BACKGROUND

Arrow rests are used in combination with a bow to support an arrow during draw of the bow's bowstring. Arrow rests can interfere with the flight of an arrow as the arrow passes the arrow rest by coming into contact with the fletching of the arrow. Thus, prior art arrow rests are designed to move the arrow rest out of the arrow's path so as not to come into contact with the arrow's fletching as the arrow passes the arrow rest. However, the prior art arrow rest designs may be cumbersome. First, in some prior art designs, the arrow rest only supports the arrow once an arrow is nocked and the bow string is drawn back bring the arrow into the firing position. In other prior art designs, the arrow rest must be manually moved into the support position and locked until the arrow is nocked and drawn into the firing position. At that point, the locking mechanism is released so that the arrow launcher may move out of the support position when the arrow is fired. Thus, the user must both support the arrow and ensure that it aligns with the arrow rest as the bow is drawn, or pause in between each shot to manually lock the arrow rest into place. Accordingly, there is a need for improved arrow rests that address one or more of the problems described above.

SUMMARY

A clutch for returning an arrow rest launcher arm to a support position, in various embodiments, comprises: (1) a body having a first end configured to operatively connect to an arrow rest cord and a second end configured to receive a moveable shaft. The shaft has a first end operatively received in the body second end and a second end configured to operatively connect to a bow. A spring is received on the shaft. The clutch is moveable between a first position in which the shaft first end is proximate the clutch body first end to facilitate the movement of an arrow rest launcher arm out of an arrow support position when an arrow is fired from the bow, and a second position in which the shaft first end is proximate the clutch body second end to facilitate movement of the arrow rest launcher arm into the arrow support position after a fletching on the fired arrow passes the arrow rest.

In various embodiments, the clutch further comprises a delay mechanism that substantially maintains the clutch in the first position for a period of time of about 0.001-0.05 seconds prior to the clutch moving from the first position into the second position. It should be understood with reference to this disclosure that substantially maintaining the clutch in the first position includes allowing the piston to move in the clutch body a distance that does not move the arrow rest launcher arm into the support position.

In various embodiments, the delay mechanism comprises: (1) fluid maintained in the clutch body; (2) a first cavity defined intermediate the piston and the clutch body first end and a second cavity defined intermediate the piston and the clutch body second end; and (3) at least one hole formed through the piston so that the first cavity is in fluid communication with the second cavity by the at least one hole, where the at least one hole is configured to allow fluid to pass between the first cavity and the second cavity.

In other embodiments, the delay mechanism comprises a valve formed in the clutch body first end where the valve is in fluid communication with the first cavity and atmosphere, and when the arrow is fired from the bow, a vacuum, that forms in the first cavity, substantially delays movement of the piston in the clutch body for a period of time of about 0.001-0.05 seconds before the clutch moves from the first position into the second position.

A clutch mechanism for allowing an arrow rest launcher arm to move from an arrow fired position into an arrow support position, in various embodiments, comprises a body having a first end configured to operatively connect to an arrow rest launcher arm and a second end configured to receive a shaft. A shaft having a first end operatively received in the body second end and a second end configured to operatively connect to a bow. The body and the shaft are moveable between a first position in which the shaft first end is proximate the clutch body first end, and a second position in which the shaft first end is proximate the clutch body second end. The body first end is operatively coupled to the arrow rest launcher arm and the shaft second end is operatively coupled to the bow. A delay mechanism is configured to substantially maintain the body and shaft in the first position for a period of time of between 0.001-0.05 seconds prior to moving from the first position into the second position.

BRIEF DESCRIPTION OF THE DRAWINGS

Having described various embodiments in general terms, reference will now be made to the accompanying drawings, which are not necessarily drawn to scale, and wherein:

FIGS. 6AA-6DD are expanded views of the clutch shown in respective FIGS. 6A-6D

DETAILED DESCRIPTION OF VARIOUS EMBODIMENTS

Various embodiments will now be described more fully herein with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overview

Figure 1:
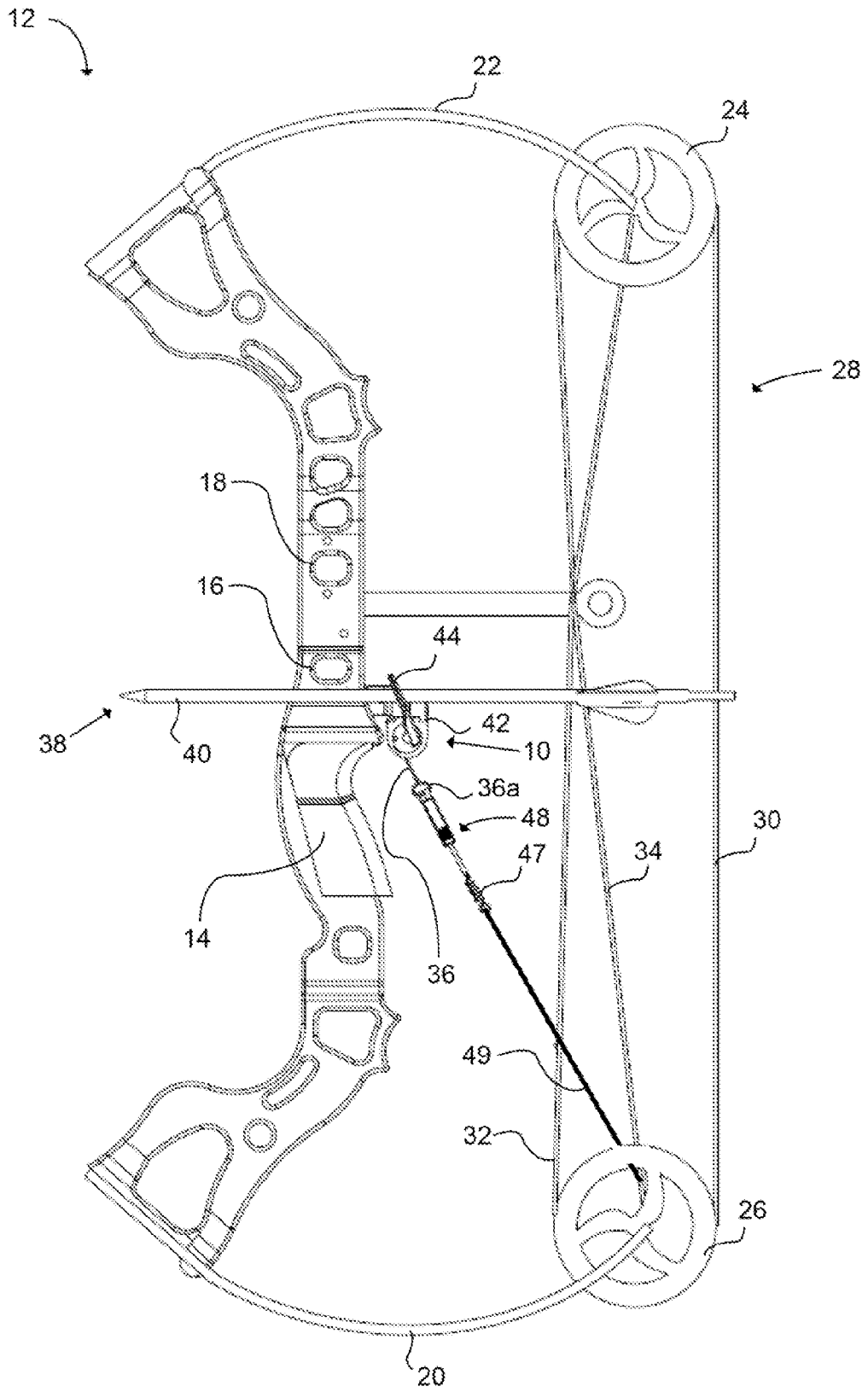
FIG. 1 is a side view of a first embodiment of an arrow rest on a bow.

A standard arrow rest 10 is shown in FIGS. 1 and 6A-6D. Referring in particular to FIG. 1, the arrow rest 10 is shown attached to a bow 12. The bow 12 has a grip 14, an arrow shelf 16, a sight window 18, a lower limb 20, an upper limb 22, an idler wheel 24, a cam 26 and a bow string generally denoted as 28. The bow string 28 can generally be broken down into segments—(1) a draw string 30 on which the arrow is nocked, (2) a second portion of the draw string 32, and (3) a buss cable 34.

The bow 12 is generally used to shoot or fire the arrow 38. The arrow 38 has a nock or notch (not numbered) in the opposite end as the arrow head (not numbered). In other words, the arrow 38 has a notch in the end laterally behind a fletch 41 of the arrow 38. The bow string 30 is fitted into the nock. The arrow 38 is then drawn back into a firing position, away from the arrow shelf 16 and the sight window 18, providing tension in the bow string 28. When the bow string 30 is released, the tension propels the arrow 38 forward.

Figure 6A:
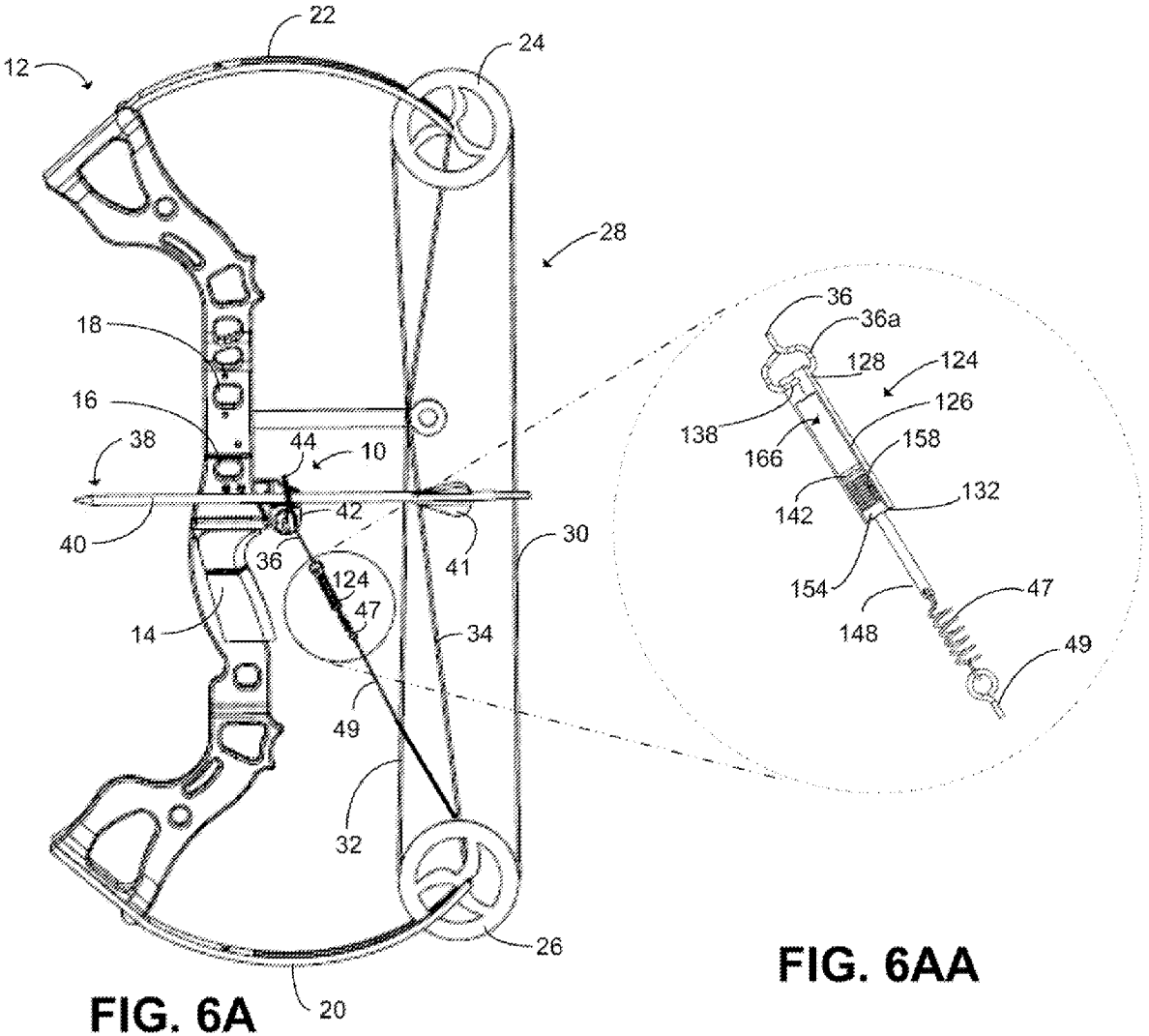
FIGS. 6A-6D are side views of the arrow rest and bow of FIG. 1 and the clutch of FIGS. 4A-4B shown in various positions of operation.

The standard arrow rest 10, as shown in FIG. 1, generally includes: (1) a body 42; (2) an arrow rest launcher arm 44; (3) a mechanism (not numbered) that is housed in the body 42 and that causes the arrow rest launcher arm to move between an arrow support position (as shown in FIG. 6A) and an arrow fired position (as shown in FIG. 6C); and (4) an arrow rest cord that is operatively coupled to the mechanism. The arrow rest body 42 is coupled to the bow via any suitable means such as screws, bolts, rivets, etc. proximate the arrow shelf 16.

During operation of the standard arrow rest 10, the arrow rest launcher arm 44 moves from the arrow fired position into the support position when tension is let off the arrow rest cord 36. That is, the mechanism in the arrow rest 10 biases the arrow rest launcher arm into the arrow support position when an arrow 38 is drawn in the bow 12 into the firing position since the buss cable 34 moves upward releasing the tension on the arrow rest cord 36. Thus, as the buss cable 34 moves up, the tension on the arrow rest cord 36 is released allowing the arrow rest launcher arm 44 to move into the arrow support position. At the moment when the arrow 38 is fired from the bow 12, the buss cable 34 rapidly moves downward, thereby quickly exerting tension on the arrow rest cord 36 moving the arrow rest launcher arm 44 out of the flight path of the arrow 38 so that the arrow fletching 41 can pass by the arrow rest 10 without being obstructed by the arrow rest launcher arm 44.

As described above, standard arrow rest designs are configured to allow the arrow rest launcher arm 44 to move into the arrow support position only when the arrow 38 is being drawn in the bow 12 into the firing position. In various embodiments of the clutch disclosed herein, the clutch is configured to allow the arrow rest launcher arm to move into the arrow support position prior to the arrow being nocked and drawn into the firing position.

Referring to FIG. 1, the clutch assembly 48 is positioned intermediate the arrow rest 10 and the bow 12. In particular embodiments, one end 36*a* of the arrow rest cord 36 is operatively coupled to a first end of the clutch assembly and the opposite end (not numbered) of the arrow rest cord 36 is operatively coupled to the arrow rest launcher arm 44 via the mechanical mechanism so that movement (e.g., lineal) of the arrow rest cord 36 causes the arrow rest launcher arm 44 to move between the support position and the firing position. An opposite end of the clutch assembly operatively couples to the bow. In various embodiments, the clutch assembly may be coupled to the bow via the buss cable 34 by a spring 47 and a cord 49. In other embodiments, the second end of the clutch assembly is coupled to the second portion 32 of the bow string 28 by the spring 47 and cord 49. In still other embodiments, the second end of the clutch assembly may be coupled to the bow limb 20 by the spring 47 and cord 49. It should be understood with reference to this disclosure that the clutch assembly may couple to the arrow rest and the bow using any suitable means.

Arrow Rest Clutch Structure

Figure 2A:
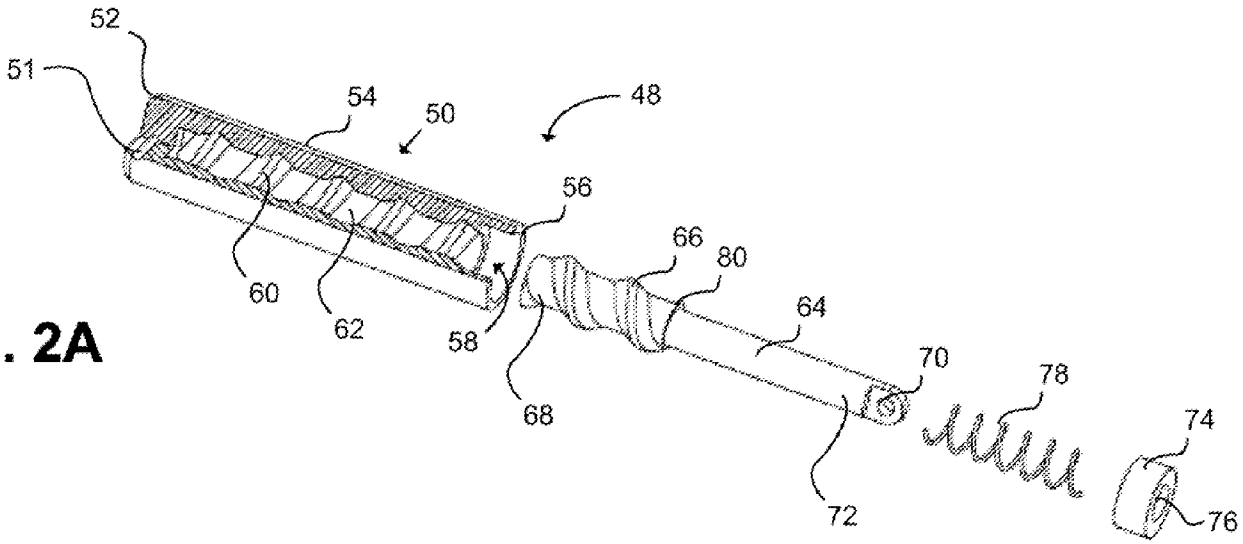
FIG. 2A is a perspective view of a clutch for use with the arrow rest and bow of FIG. 1.
Figure 2B:
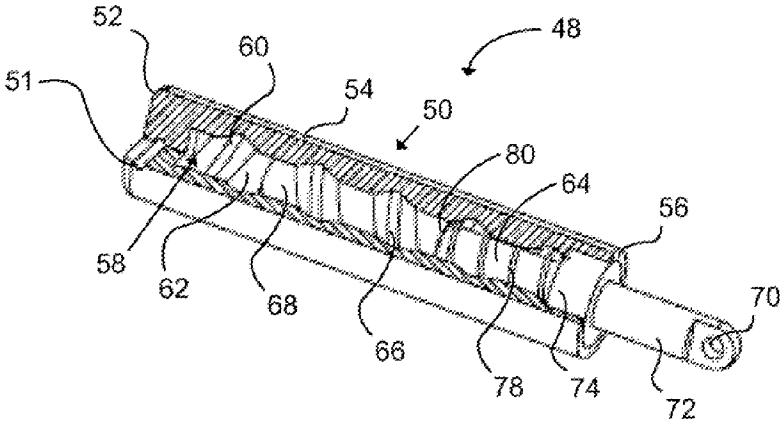
FIG. 2B is a perspective exploded view of the clutch of FIG. 2A.

Referring to FIGS. 2-4, various embodiments of the clutch assembly 48 are shown. In particular, referring to the embodiment shown in FIGS. 2A-2B, a clutch assembly 48 is shown having a generally cylindrical (e.g., cylindrical) body 50. The body 50 has a closed first end 52, a side wall 54, and an open second end 56. The closed first end 52 has a through hole 51 that is configured to receive the arrow rest cord 36, as explained in greater detail below. An inner circumference 62 of the side wall 54 defines a blind bore 58 within the body 50. A thread 60 is formed on the inner circumference 62 of the side wall 54.

An elongated shaft 64 has a thread 66 formed on a first end 68 and an eyelet 70 formed on a second end 72. A diameter of the shaft first end 68 is larger than a diameter of the shaft second end 72 thereby forming a lip 80 at the transition point. The shaft threads 66 terminate at the lip 80 intermediate the first and second ends 68 and 72 of the shaft 64. The body threads 60 and the shaft threads 66 may be formed with any thread cross-section such as a trapezoid, a triangle, a square or any other suitable cross-section that allows the shaft 64 to rotate with respect to the body 50 without binding. The body threads 60 and the shaft threads 66 may have any thread pitch, and in various embodiments, the body and the rod are designed to have between one-half and three threads per inch. In some preferred embodiments, the shaft and the body are designed to have a thread pitch of one thread per inch. In these embodiments, the shaft 64 moves one inch laterally with respect to the body 50 each time the shaft turns one full revolution.

A bushing 74, having a hole 76 formed there through, is received in the body open second end 56. The bushing may be maintained in the body opening 58 through a press fit, an adhesive, a pin, a screw, a rivet, an ultrasonic weld, or by any other suitable means that maintains the bushing in the body opening. When the bushing 74 is positioned in the body second end 56, the shaft second end 72 extends through the bushing hole 76. A spring 78 is positioned around the shaft 64 between the shaft threads 66 and the shaft second end 72. As a result, when the clutch 48 is assembled, the spring 78 is positioned intermediate the shaft lip 80 and the bushing 74.

The spring 78 functions to bias the shaft first end 68 toward the body first end 52. That is, as the spring exerts pressure against the lip 80 when it is in a compressed state, the shaft 64 rotates clockwise with respect to the body 50, through the interaction of the threads, thereby causing the shaft first end 68 to move linearly toward the closed body first end 52. Furthermore, when an opposing force pulls on the shaft second end 72, the shaft rotates counterclockwise with respect to the body 50, through the interaction of the threads, thereby moving the shaft first end 68 linearly away from the closed body first end 52 as the spring 78 compresses between the lip 80 and the bushing 74.

Figure 3A:
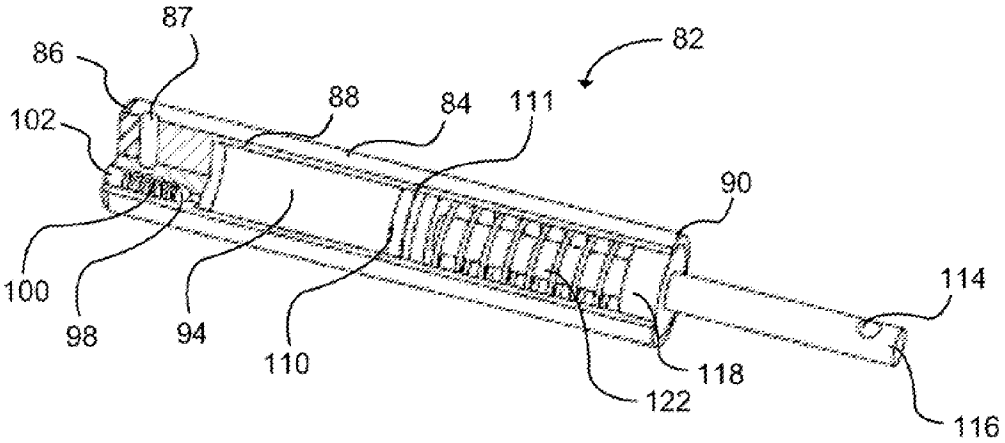
FIG. 3A is a perspective view of a clutch for use with the arrow rest and bow of FIG. 1.
Figure 3B:
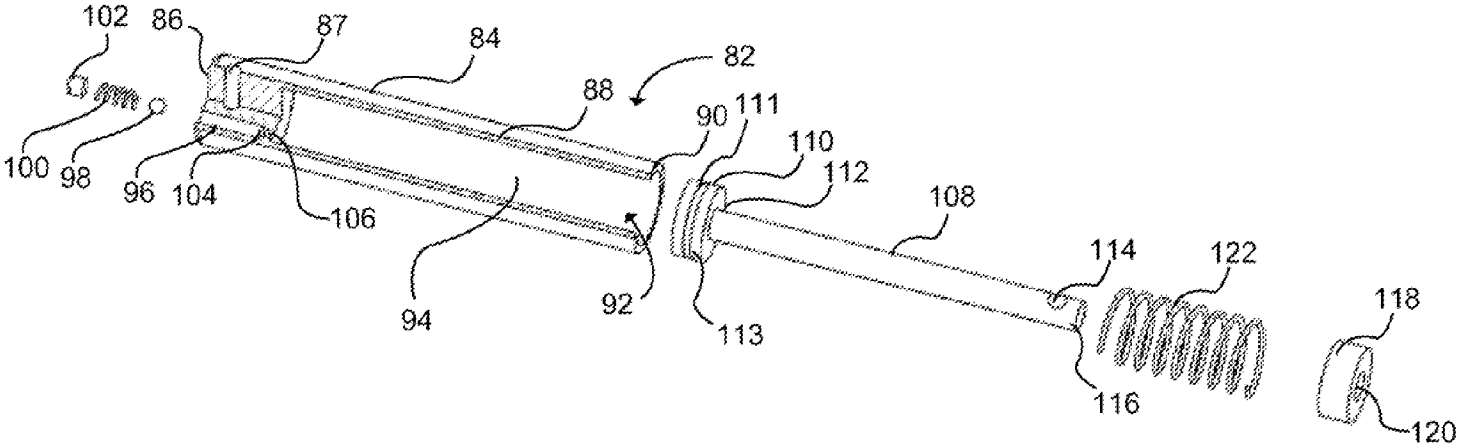
FIG. 3B is a perspective exploded view of the clutch of FIG. 3A.

In a second embodiment of a clutch assembly 82 as shown in FIGS. 3A-3B, the clutch assembly 82 has a generally cylindrical (e.g., cylindrical) body 84. The body 84 has a substantially closed first end 86, a side wall 88, and an open second end 90. An inner circumference 94 of the side wall 88 defines a blind bore 92. A through bore 96 (FIG. 3B) has a first end (not numbered) that opens to the ambient atmosphere and a second end 106 that is in fluid communication with the bore 92. The through bore 96 is configured to receive a ball 98 and a spring 100 that is maintained therein by an plug 102 (e.g., preferably an adjustable plug).

In this embodiment, the adjustable plug 102 is fit such that air may pass around the plug. The adjustable plug 102 may be press fit into the through bore 96, held by a fastener (e.g., a pin), or it may be threadably received therein. The spring 100 maintains the ball 98 substantially in a valve seat 104 at the bore second end 106 adjacent the bore 92. The valve seat 104 and the ball 98, while slowing the flow of air into the clutch body, do not create an airtight seal between the ambient atmosphere and the blind bore 92. A third hole 87 is formed in the body first end 86 and is configured to receive the arrow rest cord 36, as explained in greater detail below.

A shaft 108 has a generally cylindrical (e.g., cylindrical) piston 110 formed on a first end 112 and an eyelet 114 formed through a second end 116. An O-ring 111 is received in a circumferential groove (not numbered) formed on an outer circumference 113 of the piston 110. The O-ring 111 may be formed from rubber, polymer, or any other suitable material that will maintain an airtight seal between the piston 110 and the inner circumference 94 of wall 88.

A bushing 118, having a hole 120 formed there through, is received in the body open second end 90. The bushing may be maintained in the body open second end 90 through a press fit, an adhesive, a pin, a screw, a rivet, an ultrasonic weld, or by any other suitable means that maintains the bushing in the body opening. When the bushing 118 is positioned in the body open second end 90, the shaft second end 116 extends through the bushing hole 120. A spring 122 is positioned around the shaft 108 intermediate the piston 110 and shaft second end 116. As a result, when the clutch 82 is assembled, the spring 122 is positioned intermediate the piston 110 and the bushing 118, as shown in FIG. 3A.

When the clutch 82 is assembled, the spring 122 functions to bias the piston 110 toward the body first end 86. That is, as the spring 122 exerts pressure against the piston 110, the piston 110 moves linearly toward the body first end 86 compressing any air that is located between the piston 110 and the body first end 86. As the spring 122 continues to force the piston 110 toward the body first end 86, the air pressure escapes out of the clutch body through the hole second end 106 by dislodging the ball 98 from the valve seat 104 against the bias of spring 100. The plug 102 and the design of the spring 100 may be used to regulate the rate that air may escape from the clutch body first end 86 so as to regulate the speed in which the shaft 108 moves through the clutch body 84.

The clutch design shown in FIGS. 3A-3B is configured to initially provide resistance when the shaft second end 116 is pulled to the right, as shown in FIG. 3A, out of the clutch body 84. That is, as tension is placed on the shaft second 116, the piston 110 is initially prevented from moving away from the clutch body first end 86 by a vacuum that forms between the piston 110 and the clutch body first end 86 as the shaft 108 is pulled to the right (FIG. 3A) against the bias of the spring 122. The vacuum pressure initially causes a delay in the movement of the piston and shaft with respect to the body 84, as further discussed below. As the vacuum dissipates from ambient atmosphere that can leak between: 1) the ball 98 and the valve seat 104; and 2) the adjustable plug 112 and the through bore 96, the piston 110 begins to move away from the clutch body first end 86. Once the pressure equalizes, the piston moves freely to the right against the bias of the spring 122.

Once the tension on the shaft second end 116 is released, the force of the extension spring 122 biases the piston 110 back to the left toward the clutch body first end 86. As the shaft 108 and the piston 110 begin to move to the left (FIG. 3A) with respect to the clutch body 88, air located between the piston 110 and the clutch body first end 86 is forced out of the clutch body via the through hole second end 106, as the ball 98 is dislodged from the valve seat 104, and out to ambient atmosphere around the plug 102. As a result, the clutch is moveable between a first contracted position where the piston 110 is proximate the clutch body first end 86 and a second extended position where the piston 110 is proximate the clutch body second end 90.

Figure 4A:
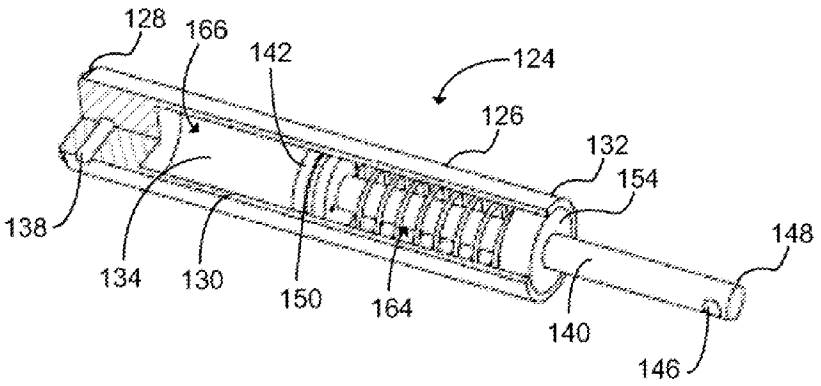
FIG. 4A is a perspective view of a clutch for use with the arrow rest and bow of FIG. 1.
Figure 4B:
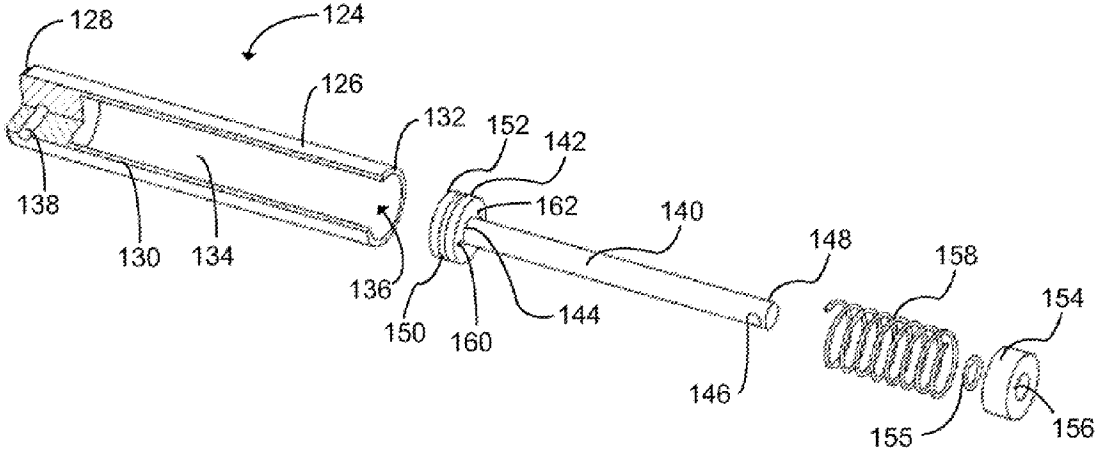
FIG. 4B is a perspective exploded view of the clutch of FIG. 4A.

In a final embodiment shown in FIGS. 4A-4B, the clutch assembly 124 has a generally cylindrical (e.g., cylindrical) clutch body 126. The clutch body 126 has a substantially closed first end 128, a side wall 130, and an open second end 132. An inner circumference 134 of side wall 130 defines a blind bore 136. A through bore 138 is configured to receive the arrow rest cord 36 from the arrow rest, as explained in greater detail below.

A shaft 140 has a generally cylindrical (e.g., cylindrical) piston 142 formed on a first end 144 and an eyelet 146 formed on a second end 148. An O-ring 150 is received in a circumferential groove (not numbered) formed on an outer circumference 152 of the piston 142. The seal 150 may be formed from rubber, polymer, or any other suitable material that maintains a seal between the piston 142 and the inner circumferential 134 of wall 130.

A bushing 154, having a hole 156 formed there through, is received in the body open second end 132. The bushing 154 may be maintained in the body open second end 132 through a press fit, an adhesive, a pin, a screw, a rivet, an ultrasonic weld, or by any other suitable means that maintains the bushing in the body opening. When the bushing 154 is positioned in the body open second end 132, the shaft second end 148 extends through the bushing hole 156. A bushing O-ring 155 (FIG. 4B) is received in a groove (not shown) formed in the bushing 154 so as to form a seal when the shaft first end 148 is passed through the bushing hole 156. A spring 158 is positioned around the shaft 140 intermediate the piston 142 and the shaft second end 148. As a result, when the clutch 124 is assembled, the spring 158 is positioned intermediate the piston 142 and the bushing 154, as shown in FIG. 4A.

The piston 142 divides the bore 136 into two sections—the first cavity 164 between the piston 142 and the bushing 154 and the second cavity 166 between the piston 142 and the body first end 128. The piston 142 has two through holes 160 and 162 that allow the first cavity 164 to be in fluid communication with the second cavity 166. This configuration allows fluid (not shown) that is maintained in the clutch body bore 136 to pass from one side of the piston 142 to the other. Thus, the size of the holes 160 and 162 and the design of the spring 158 determine when and how fast the piston 142 moves within the clutch body 126. That is, the larger the holes 160 and 162, the faster the fluid can move from the first cavity 164 to the second cavity 166 thereby allowing the piston to move through the clutch body. Moreover, the piston holes 160 and 162 also act as a delay mechanism since the piston will not begin to move until a sufficient amount of fluid passes through the holes into the second cavity 166. As such, the size of the holes and the viscosity of the fluid also determine the period of time that the clutch is maintained in the first position until a sufficient amount of fluid flows from the first cavity 164 into the second section 166.

Exemplary Clutch Operation

Figure 5A:
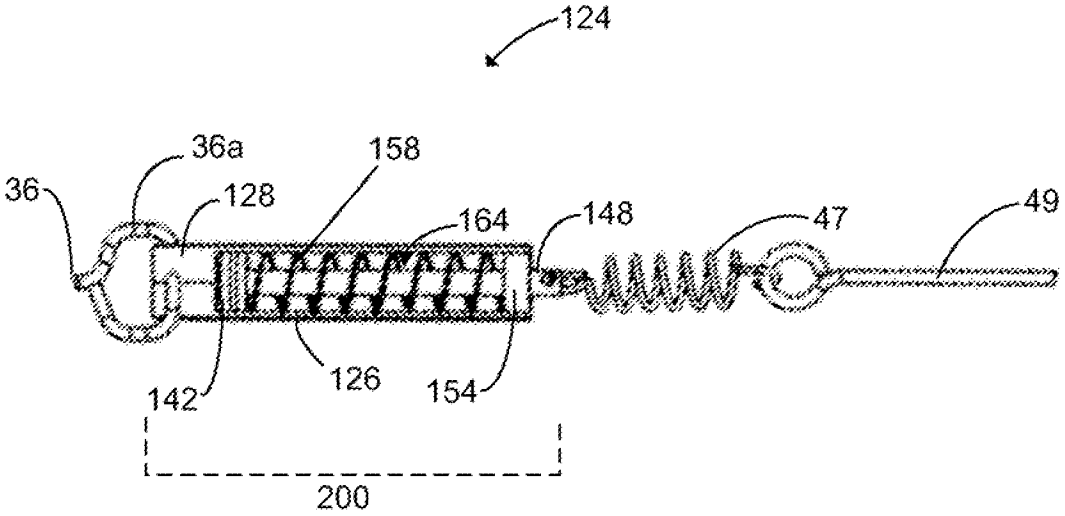
FIGS. 5A-5C show the exemplary operation of a clutch for use with the arrow rest and bow of FIG. 1.
Figure 5B:
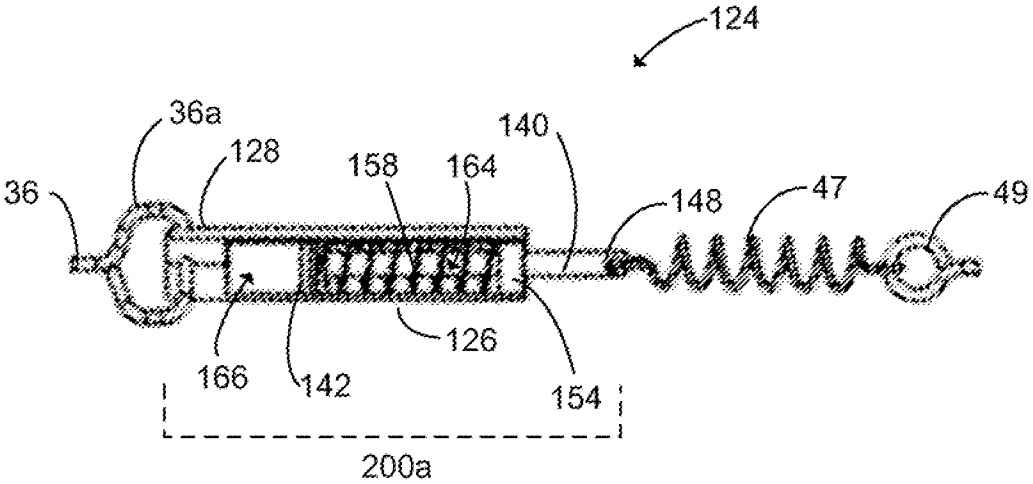
Figure 5C:
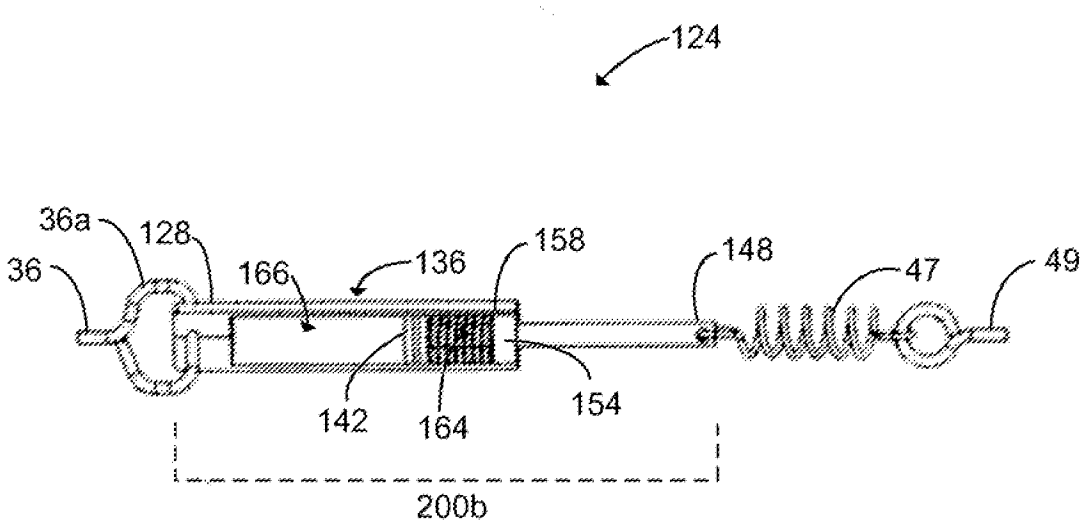

FIGS. 5A-5C show an exemplary clutch assembly for use in with the arrow rest and bow. While a clutch for use with an arrow rest and bow can have many uses, in this exemplary embodiment, the clutch provides a controlled increase and decrease in the length of the cable connecting the arrow rest assembly to the bow as the clutch assembly moves between a compressed first position into an extended second position. This controlled length-change affects when and at what rate the arrow rest arm (e.g., the arrow rest arm 44 in FIG. 1) is raised or lowered. In this example, as the clutch moves from the compressed first position into the extended second position, the overall length of the clutch assembly changes by about 0.25 to 2 inches and provides about 0.001-0.05 seconds delay before beginning to move from the compressed first position into the extended second position with a total time to full extension of about 0.25-5 seconds. For ease of explanation, the exemplary clutch assembly 124 from FIGS. 4A-4B is used in this example.

FIG. 5A shows the clutch assembly installed between the arrow rest and the bow. In particular, the clutch body second end is coupled to the arrow rest by the arrow rest cord 36 by attaching the arrow rest cord first end 36*a* through the clutch body hole 138. The cord 49, received through the shaft eyelet 146 couples the shaft second end 148 to the bow 12. As shown, the clutch assembly 124 is in a first compressed position where the springs 158 and 47 are substantially at rest and piston 142 is positioned proximate the clutch body first end 128 and the first cavity 164 is maximized. In other words, substantially all of the fluid in the clutch body 126 is to the right of the piston 142. In this configuration, the clutch-assembly length 200 is the smallest, or sum length X.

FIG. 5B shows the clutch assembly 124 partially extended between the first compressed position and the second extended position. Here, lateral force is exerted on one or both of arrow rest cord 36 and cord 49. As the force is initially exerted, the clutch assembly 124 resists movement (e.g., there is a delay for a period of time before the shaft begins to move in the clutch body) since all of the fluid is substantially located to the right of the piston 142. The force exerted on one or both of the arrow rest cord 36 and cord 49 is such that spring 47 extends.

As the pressure builds in the second cavity 166, the fluid is forced though the piston holes 160 and 162 to the other side of the piston 142. Additionally, the lateral forces must also overcome the force exerted by spring 158. Once the piston 142 begins to move to the right in the clutch body 126, the second cavity 166 begins to expand and fill with fluid as the first cavity 164 begins to shrink. In the position shown in FIG. 5B, the length 200*a* of the clutch assembly increases by the length of the second cavity 166 at any point during movement from the compressed first position into the extended second position, for example if the second cavity 166 shown in FIG. 5B is about 0.375 inches, then the length 200*a* is about X+0.375 inches.

The viscosity of the fluid in the clutch body, the design of the spring 158, and the size of the holes 160 and 162 in the piston 142 affect the period of time of the delay that occurs prior to the clutch assembly moving from the compressed first position into the extended second position. In various embodiments, the period of time of the delay is about 0.001-0.05 seconds before the piston 142 beings to move out of the compressed first position. In some preferred embodiments, the period of time of the delay is about 0.007-0.012 seconds, and in more preferred embodiments the period of time of the delay is no longer than 0.02 seconds. However, it should be understood with reference to this disclosure that the clutch assembly 124 may be designed to accommodate any period of time of a delay depending on the design of the bow 12, the arrow rest 10 and the arrow 38.

Referring to FIG. 5C, as lateral force is continually exerted on one or both of arrow rest cord 36 and cord 49, the clutch assembly continues to move into the extended second position where the piston 142 is proximate the bushing 154 and the spring 158 is fully compressed. In this position, the length of the first cavity 164 is minimized and the length of the second cavity 166 is at its maximum length, which may be in a range of about 0.25-2 inches. In various embodiments, the maximum length of the second cavity may be in a range of about 0.3-1.25 inches, and in more preferred embodiments, the maximum length of the second cavity is in a range of about 0.5-1.0 inches. Moreover, the length 200*b* of the clutch assembly 124 is at its maximum of about X+0.75 inches. The total time for the clutch to move from the compressed first position (FIG. 5A) into the extended second position (FIG. 5C) in various embodiments is about 0.25-5 seconds.

Based on the above description, the clutch assembly 124 can increase the combined length of the arrow rest cord 36 and the cord 49 connecting the arrow rest assembly and the bow (e.g., from the configuration in FIG. 5C to the configuration in FIG. 5A) thereby facilitating movement of the arrow rest launcher arm 44 from the arrow fired position (e.g., when the clutch is in the compressed first position) into the support position (e.g., when the clutch is in the extended second position).

Exemplary Use

Operation of the arrow rest and clutch assembly will now be described with reference to FIGS. 6A-6D and 6AA-6DD using the clutch assembly 124 shown in FIGS. 4A-4B. Referring to FIGS. 6A and 6AA, the bow 12 is shown with the arrow 38 nocked on the bow string 30. The clutch assembly is in the extended second position and the arrow rest 10 is shown with the arrow rest launcher arm 44 in the arrow support position. In this configuration, the piston 142 is located proximate the clutch body second end 132 and the spring 158 is compressed. The spring 47 is in a closed state since the tension on the arrow rest cord 36 and the cord 49 does not overcome the compression force of the spring 47. In various embodiments, the clutch length extends by about 0.75 inches to facilitate movement of the arrow rest launcher arm 44 into the arrow support position to support the arrow shaft 40.

Figure 6B:
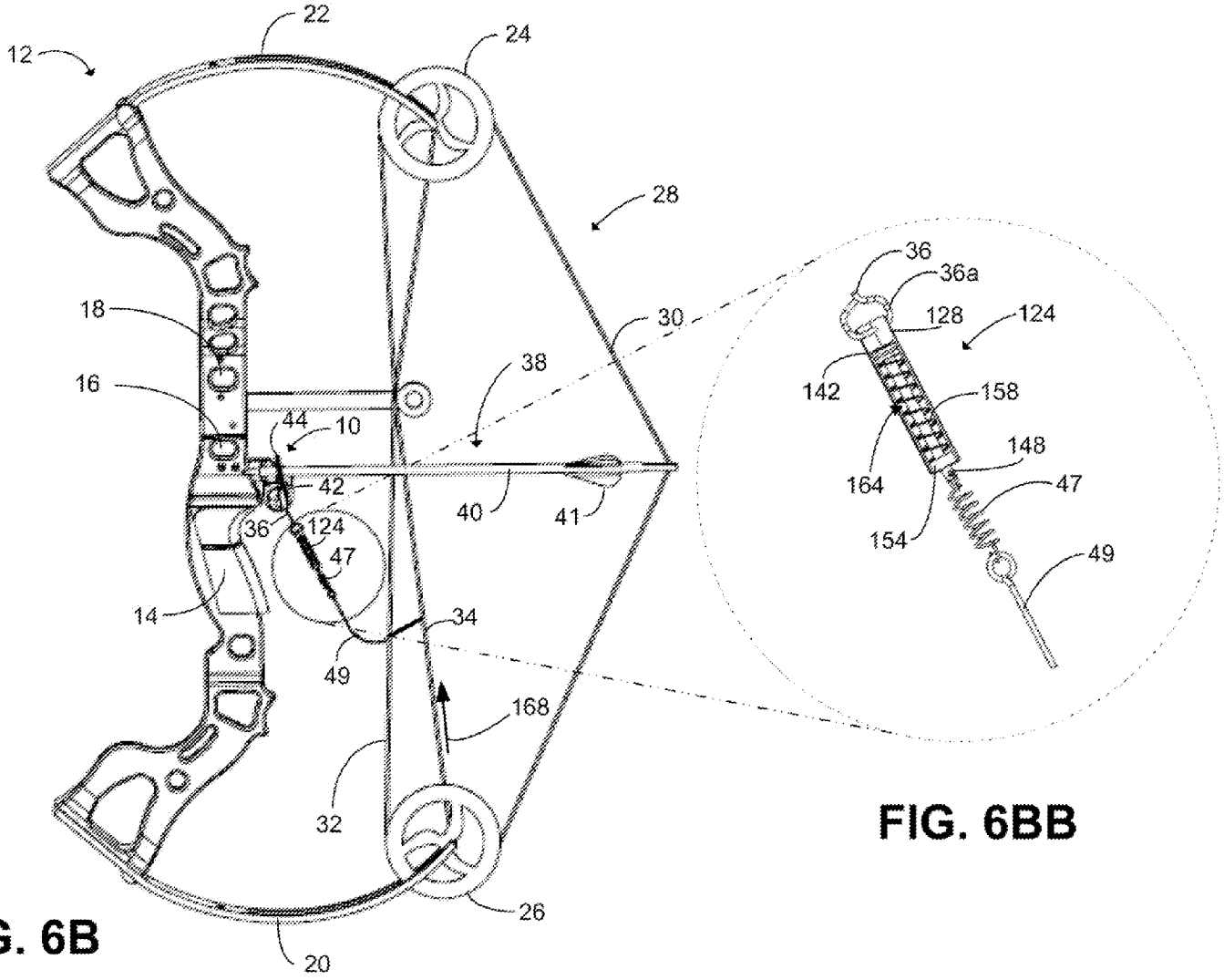
Figure 6C:
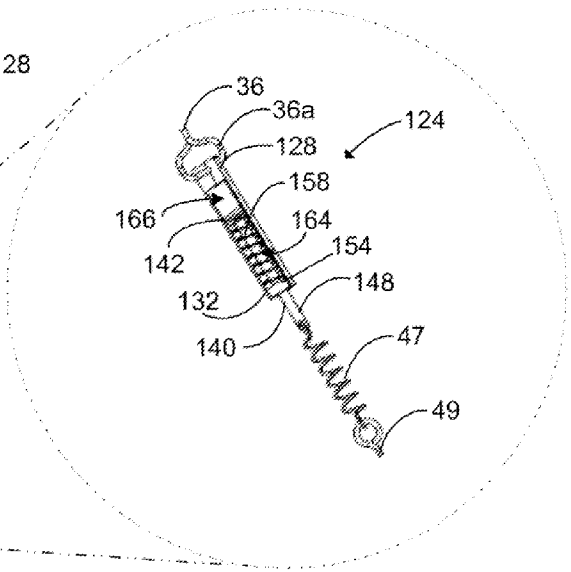
Figure 6C:
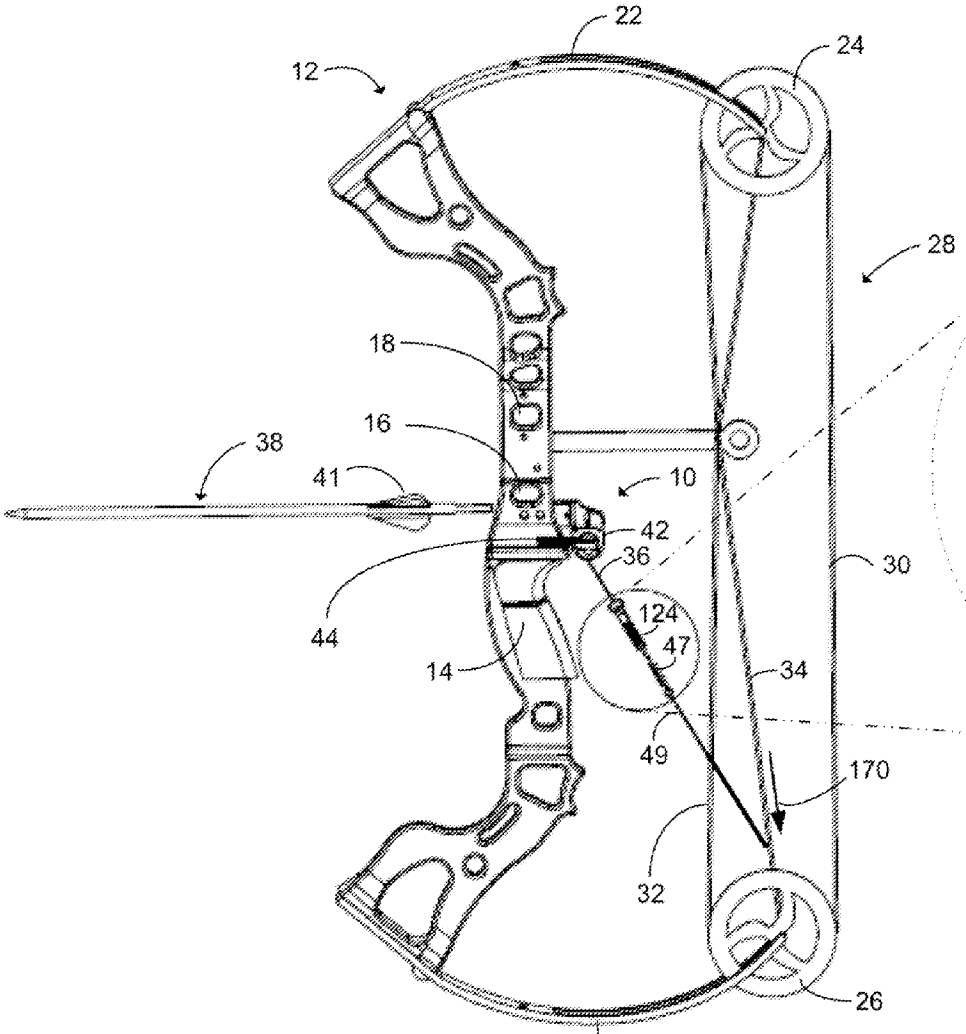

Referring to FIGS. 6B and 6BB, the bow 12 is shown with the arrow 38 drawn into a firing position. As the user draws the arrow back into the firing position, the buss cable 34 moves up in the direction shown by arrow 168 thereby providing slack in the cord 49. As the slack develops, the clutch spring 158 biases the piston 142 from the second position (shown in FIG. 5A) into the first position (e.g., the compressed state) where the piston 142 is proximate the clutch body first end 128. The time it takes for the piston to move from the second position into the first position is dependent on the flow rate of the fluid through the piston holes 160 and 162, the viscosity of the fluid, and the extension force exerted by the spring 158. As the piston moves toward the first position, the first cavity 164 expands. The overall length of the clutch shortens by about 0.75 inches. Because there is slack in the cord 49, the spring 47 does not expand as the overall length of the clutch shortens, and the arrow rest launcher arm 44 stays in the arrow support position.

Referring to FIGS. 6C and 6CC, the bow 12 is shown with the arrow 38 fired. Immediately before the arrow is fired, the clutch assembly is in the first position where the piston 142 is proximate the clutch body first end 128. Immediately after the bow string 30 is released, the buss cable 34 rapidly moves in the direction of arrow 170 thereby exerting a downward force on the cord 49. The sudden downward force exerts a pulling force on the shaft second end 148. However, the delay mechanism substantially maintains the piston 142 proximate the clutch body first end 128 for the delay period of about 0.001-0.05 of a second. This delay of movement of the piston 142 facilitates movement of the arrow rest launcher arm 44 from the arrow support position into the arrow fired position so that the arrow rest launcher arm 44 does not obstruct the flight path of the arrow 38. Once the arrow 38 clears the arrow rest 10, the clutch 124 begins to move from the first position (e.g., compressed position) into the second position (e.g., extended position). That is, as shown in FIG. 6CC: (1) the piston 142 begins to move laterally toward the bushing 154; (2) the fluid begins to pass from the first cavity 164 into the second cavity 166 through the piston holes 160 and 162; (3) the first cavity 164 beings to shrink and the second cavity 166 begins to expand; and (4) the spring 47 is stretched to absorb some of the sudden force exerted to prevent the arrow rest cord 36 and the cord 49 from breaking.

Figure 6D:
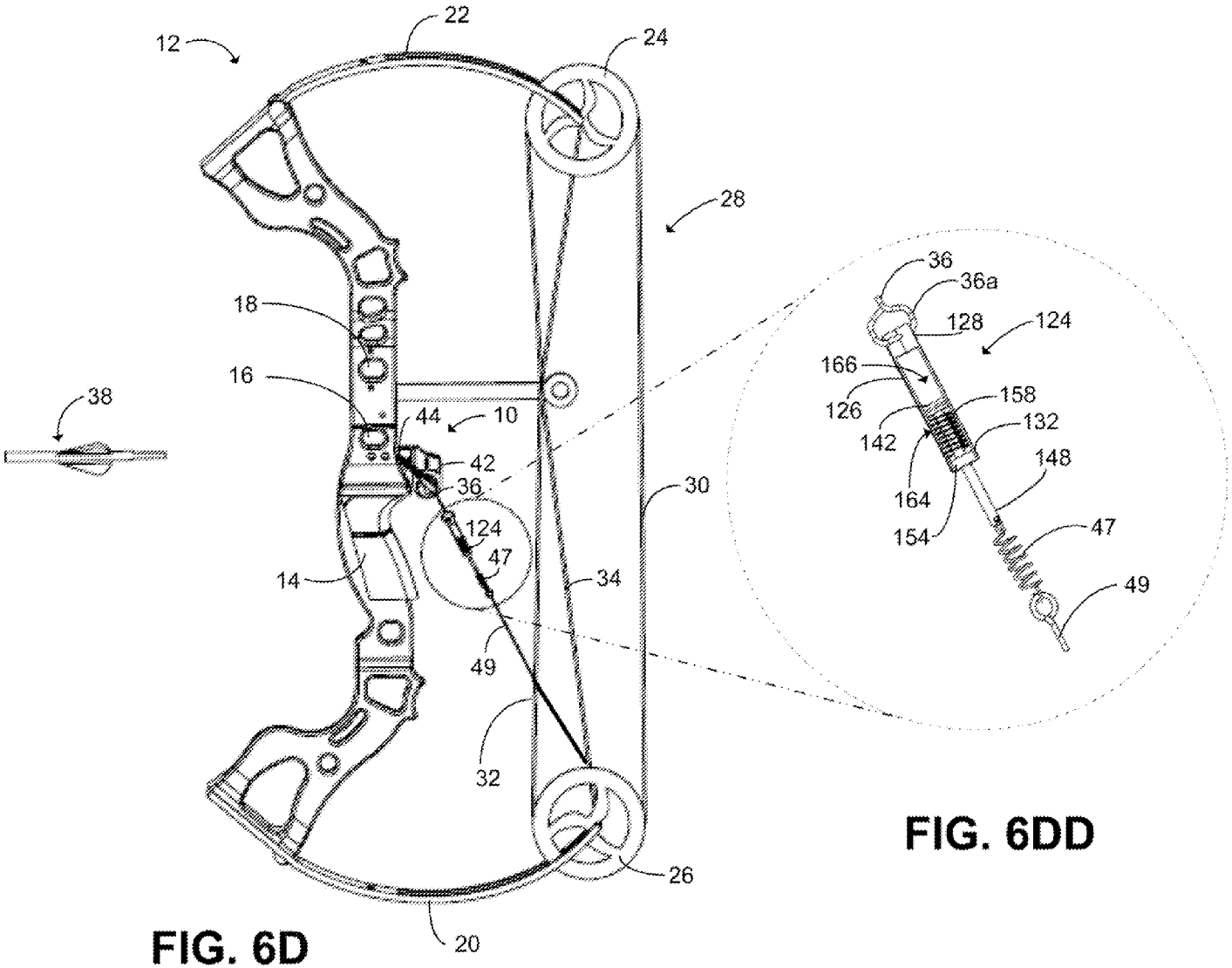

Referring to FIGS. 6D and 6DD, as the piston 142 moves toward the bushing 154, the arrow rest launcher arm 44 continues to move from the fired position into the support position against the bias of spring 158. Fluid continues to move from the first cavity 164 into the second cavity 166 through the piston holes 160 and 162. Finally, the spring 47 is no longer extended. The piston 142 continues to move until the arrow rest launcher arm moves into the arrow support position as shown in FIG. 6A. As discussed herein, the total time for the arrow rest launcher arm 44 to move from the fired position into the support position is substantially the same amount of time that it takes for the clutch to move from the first position into the second position of about 0.25-5 seconds.

Second Embodiment

Figure 7:
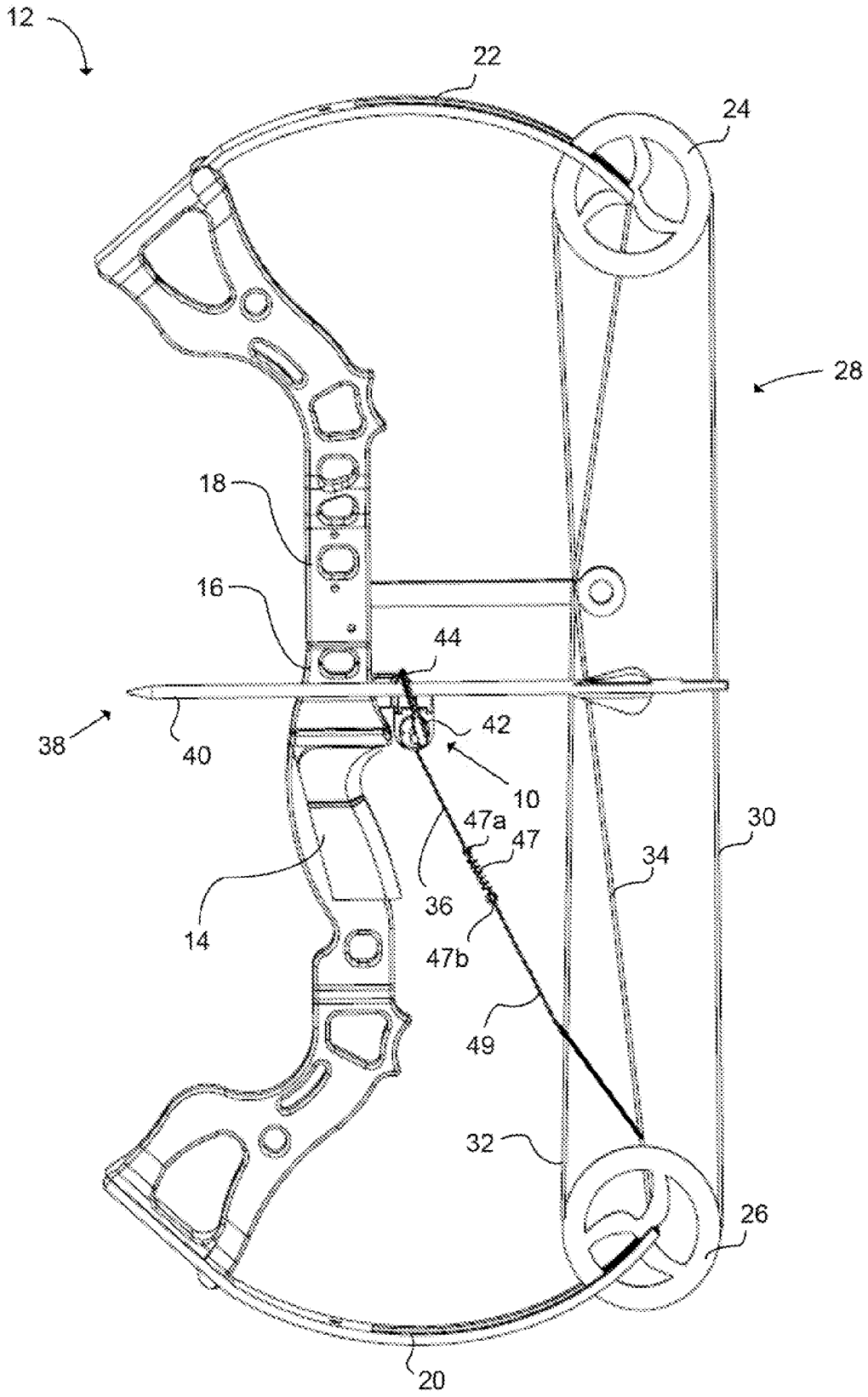
FIG. 7 is a side view of a second embodiment of arrow rest on a bow.

In a second embodiment, the arrow rest 10 is connected to the bow 12 via the spring 47 without including the clutch as described above. Referring to FIG. 7, the arrow rest cord 36 is operatively coupled to a first end 47*a* of the spring 47. A second end 47*b* of the spring 47 is operatively coupled to the cord 49. In other embodiments, the spring 47 couples to the arrow rest and the bow using any other suitable means.

Still referring to FIG. 7, when the bow is at rest as shown in the figure, the arrow rest launcher arm 44 is in the fired position. Once an arrow is nocked and drawn into the firing position, the buss cable 34 moves upward thereby providing slack in one or both of the arrow rest cord 36 and the cord 49. The slack allows the mechanism in the arrow rest 10 to bias the arrow rest launcher arm into the arrow support position. Immediately after the bow string 30 is released (e.g., when the arrow 38 is fired), the buss cable 34 rapidly moves downward toward the lower limb 20, thereby exerting a downward force on the cord 49 and the arrow rest cord 36. The spring 47 is configured to absorb the sudden downward force exerted on the arrow rest cord 36 and the cord 49 to prevent them from breaking.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed and that the modifications and other embodiments are intended to be included within the scope of the appended exemplary concepts. Although specific terms are employed herein, they are used in a generic and descriptive sense only and not for the purposes of limitation. The description of the above exemplary embodiments should teach one of skill in the art that many more alternatives exist that can facilitate movement of the arrow rest launcher arm from the fired position into the arrow support position.

While the clutch operation was generally described with reference to the clutch of FIGS. 4A-4B, the parameters of operation, such as the delay period of time and the total time to move the arrow rest launcher arm 44 from the fired position into the arrow support position, equally apply to the clutch assembly shown in FIGS. 3A-3B. Moreover, with respect to the clutch assembly 48 shown in FIGS. 2A-2B, it should be understood from reference to this disclosure that the delay mechanism for the clutch assembly 48 is carried out by the interaction of the shaft threads and the clutch body threads. In particular, the pitch of the threads determines the amount of time that it takes the arrow rest launcher arm 44 to move a sufficient amount to where it will not obstruct the flight path of the arrow by interfering with the arrow fletching 41. Thus, the design of the threads provides the proper period of time of delay, and a design of about one thread per inch provides a sufficient amount of time to allow the arrow to pass unobstructed once fired.

I claim:

1. An archery device comprising:

a. a bow;

b. an arrow rest coupled to the bow, wherein the arrow rest comprises an arrow rest launcher arm that is operatively coupled to a portion of the bow that is moveable with respect to the arrow rest by an arrow rest cord and a clutch;

c. the clutch comprising:

i. a clutch body having a first end that connects to one of the arrow rest cord or the moveable portion of the bow and a second end;

ii. a clutch shaft having a first end operatively received in the body second end and a second end that connects to the other of the arrow rest cord or the moveable portion of the bow; and d. a spring received on the shaft, wherein the clutch is moveable between:

(1) a first position when the bow is drawn into a firing position in which the shaft first end is proximate the clutch body first end to facilitate movement of an arrow rest launcher arm out of an arrow support position when an arrow is fired from the bow, and (2) a second position when the bow is at rest in which the shaft first end is proximate the clutch body second end to facilitate movement of the arrow rest launcher arm into the arrow support position after a fletching on the fired arrow passes the arrow rest.

2. The archery device of claim 1, wherein a. the spring is received on the shaft intermediate the shaft first end and the clutch body second end; and b. the spring is configured to bias the shaft from the second position into the first position.

3. The archery device of claim 2, further comprising a piston coupled to the shaft first end.

4. The archery device of claim 3, further comprising a delay mechanism that substantially maintains the clutch in the first position for a period of time of about 0.001-0.05 seconds prior to the clutch moving from the first position into the second position.

5. The archery device of claim 4, wherein the delay mechanism further comprises:

a. fluid maintained in the clutch body;

b. a first cavity defined intermediate the piston and the clutch body first end and a second cavity defined intermediate the piston and the clutch body second end; and c. at least one hole formed through the piston so that the first cavity is in fluid communication with the second cavity by the at least one hole, wherein the at least one hole is configured to allow fluid to pass between the first cavity and the second cavity.

6. The archery device of claim 1, wherein the shaft second end is operatively coupled to a portion of the bow selected from a group consisting of:

a. the bow string;

b. the buss cable; and c. a limb of the bow.

7. The archery device of claim 6, wherein a. the shaft second end is operatively coupled to the buss cable; and b. when the arrow is fired from the bow, the clutch moves from the first position into the second position to allow the arrow rest launcher arm to move into the support position.

8. The archery device of claim 7, wherein the clutch is configured to change the length of the arrow rest cord when the clutch moves between the first position and the second position.

9. The archery device of claim 1, wherein a. the clutch body has a threaded bore formed in the second end;

b. the shaft first end has a thread formed thereon; and c. when the shaft rotates with respect to the clutch body, the clutch moves from the first position into the second position via interaction of the threads.

10. The archery device of claim 4, wherein:

a. the clutch further comprises a first cavity formed intermediate the piston and the clutch body first end, and a second cavity intermediate the piston and the clutch body second end; and b. the delay mechanism further comprises a valve formed in the clutch body first end, wherein the valve is in fluid communication with the first cavity and atmosphere, and when the arrow is fired from the bow, a vacuum, that forms in the first cavity, substantially delays movement of the piston in the clutch body for a period of time of about 0.001-0.05 seconds before the clutch moves from the first position into the second position.

11. The archery device of claim 10, wherein the period of time is no more than 0.02 seconds.

12. The archery device of claim 1, wherein when the clutch moves from the first position into the second position, a length of the clutch increases by about 0.25-2 inches.

13. The archery device of claim 1, wherein the arrow rest is operatively coupled to the clutch body first end.

14. The archery device of claim 1, wherein the bow is operatively coupled to the shaft second end.

15. An archery device comprising:

a. a bow;

b. an arrow rest launcher arm operatively coupled to the bow at a first location; and c. a delay mechanism comprising:

i. a body having a first end and an opposite second end; and ii. a shaft having a first end operatively received in the body second end and a second end, wherein:

(1) one of the body first end or the shaft second end couples to a cord operatively coupled to the arrow rest launcher arm and the other of the body first end or the shaft second end couples to a portion of the bow that moves with respect to the arrow rest launcher arm, (2) the body and shaft are moveable between:

a first position in which the shaft first end is proximate the clutch body first end, and a second position in which the shaft first end is proximate the clutch body second end, and (3) the delay mechanism substantially maintains the body and shaft in the first position for a period of time of between 0.001-0.05 seconds prior to moving from the first position into the second position after the bow is fired.

16. The archery device of claim 15, wherein the shaft second end is operatively coupled to a buss cable of the bow.

17. The archery device of claim 15, wherein the clutch body first end is operatively coupled to a cord of the arrow rest.

18. The archery device of claim 15, the shaft first end further comprising a piston that is slidably received in the body second end.

19. The archery device of claim 18, wherein the delay mechanism further comprises:

a. at least one hole formed through the piston so that a first cavity is in fluid communication with a second cavity by the at least one hole; and b. fluid that is received in the body and that passes between the first cavity and the second cavity as the piston slides in the clutch body.

20. The archery device of claim 18, the delay mechanism further comprising a valve formed in the clutch body first end, wherein a cavity formed between the piston and the clutch body first end is in fluid communication with the atmosphere by the valve.

21. The archery device of claim 15, wherein a. when the body and the shaft are in the first position, the shaft first end is proximate the body first end, and b. when the body and the shaft are in the second position, the shaft first end is proximate the body second end.

22. The archery device of claim 21, wherein a. when the clutch is in the first position and an arrow is fired from the bow, the clutch facilitates movement of the arrow rest launcher arm from the arrow support position into the arrow fired position; and b. when the period of time substantially expires, the clutch moves into the second position thereby facilitating movement of the arrow rest launcher arm into the arrow support position.

23. The archery device of claim 15, wherein when the clutch moves from the first position into the second position, a length of the clutch increases by a sufficient amount to facilitate movement of the arrow rest launcher arm from the fired position into the arrow support position.

24. The archery device of claim 23, wherein the sufficient amount is approximately 0.75 inches.

25. The archery device of claim 15, wherein movement of the delay mechanism from the first position to the second position lengthens the cord.

* * * * *